US008616029B2

(12) United States Patent
Maentele et al.

(10) Patent No.: US 8,616,029 B2
(45) Date of Patent: Dec. 31, 2013

(54) WASHING MACHINE WITH A DIRECT DRIVE SYSTEM

(75) Inventors: Gerd Maentele, Urbach (DE); Antonio Francesco Chiriatti, Schorndorf (DE); Pavol Petracek, Schorndorf (DE); Kurt Werner, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 733 days.

(21) Appl. No.: 12/814,539

(22) Filed: Jun. 14, 2010

(65) Prior Publication Data

US 2010/0307202 A1 Dec. 9, 2010

(51) Int. Cl.
*D06F 21/00* (2006.01)

(52) U.S. Cl.
USPC ..... 68/140

(58) Field of Classification Search
USPC ..... 68/24, 140
See application file for complete search history.

(56) References Cited

U.S. PATENT DOCUMENTS

| | | | | |
|---|---|---|---|---|
| 4,813,248 | A * | 3/1989 | Smith et al. | 68/23.7 |
| 5,720,065 | A | 2/1998 | Myers et al. | |
| 5,809,809 | A | 9/1998 | Neumann | |
| 6,050,113 | A | 4/2000 | Skrippek et al. | |
| 6,131,422 | A | 10/2000 | Skrippek et al. | |
| 6,474,114 | B1 | 11/2002 | Ito et al. | |
| 6,477,869 | B2 | 11/2002 | Heyder et al. | |
| 6,510,716 | B1 | 1/2003 | Kim et al. | |
| 6,539,753 | B1 | 4/2003 | Ito et al. | |
| 6,564,594 | B1 | 5/2003 | Ito et al. | |
| 6,618,887 | B2 * | 9/2003 | Kim et al. | 8/158 |
| 6,626,014 | B2 | 9/2003 | Heyder et al. | |
| 6,655,177 | B2 | 12/2003 | Bierbach et al. | |
| 6,681,602 | B2 | 1/2004 | Heyder et al. | |
| 7,076,975 | B2 | 7/2006 | Heyder et al. | |
| 7,089,769 | B2 | 8/2006 | Lim et al. | |
| 7,131,178 | B2 | 11/2006 | Kim et al. | |
| 7,490,489 | B2 | 2/2009 | Kim et al. | |
| 7,520,148 | B2 | 4/2009 | Choi | |
| 7,548,003 | B2 | 6/2009 | Nickel-Jetter et al. | |

(Continued)

FOREIGN PATENT DOCUMENTS

| | | | |
|---|---|---|---|
| CN | 201151827 | Y | 11/2008 |
| DE | 19859568 | A1 | 6/2000 |

(Continued)

OTHER PUBLICATIONS

European search report for corresponding EP08103960.4, Oct. 17, 2008.

Evangelos Papadopoulos and Iakovos Papadimitriou, "Modeling, Design and Control of a Portable Washing Machine During the Spinning Cycle", Proceedings ofthe 2001 IEEE/ASME International Conference on Advanced Intelligent Mechatronics Systems (AIM 2001), Jul. 8-11, 2001, Como, Italy, pp. 899-904.

US RE40,856, 07/2009, Kim et al. (withdrawn)

*Primary Examiner* — David Cormier

(57) ABSTRACT

A washing machine with a direct drive system including a tub, a drum rotatably mounted inside the tub, a shaft connected to the drum at a first end for transmission of a driving force of a direct drive motor, a coaxial support connected to a rear portion of the tub and having a first seat for a first bearing supporting a second end of the shaft opposite the drum, a stator secured to the coaxial support and having a plurality of magnetic cores, a rotor including permanent magnets and connected to the shaft, and a second bearing for supporting the shaft between the second end and the first end. The tub is made of polymeric material in which a second seat for said second bearing is co-molded.

14 Claims, 4 Drawing Sheets

(56) References Cited

U.S. PATENT DOCUMENTS

| | | | | |
|---|---|---|---|---|
| 7,578,149 | B2 | 8/2009 | Schmid et al. | |
| 7,596,973 | B2 | 10/2009 | Kim et al. | |
| 7,640,771 | B2 | 1/2010 | Fechtel et al. | |
| 2002/0194884 | A1 | 12/2002 | Heyder et al. | |
| 2003/0006665 | A1 * | 1/2003 | Kim et al. | 310/231 |
| 2003/0015005 | A1 | 1/2003 | Heyder et al. | |
| 2004/0055143 | A1 | 3/2004 | Kim et al. | |
| 2005/0092034 | A1 | 5/2005 | Hollenhorst et al. | |
| 2006/0096329 | A1 | 5/2006 | Kim et al. | |
| 2008/0148785 | A1 | 6/2008 | Lee et al. | |
| 2009/0038349 | A1 | 2/2009 | Yoon | |
| 2009/0165506 | A1 * | 7/2009 | Marquina et al. | 68/142 |
| 2009/0199599 | A1 | 8/2009 | Choi | |
| 2009/0211035 | A1 | 8/2009 | Kim et al. | |
| 2009/0211310 | A1 | 8/2009 | Kim et al. | |
| 2010/0038985 | A1 | 2/2010 | Shim et al. | |
| 2010/0050703 | A1 | 3/2010 | Maekawa et al. | |
| 2010/0058817 | A1 | 3/2010 | Yoshikawa et al. | |

FOREIGN PATENT DOCUMENTS

| | | | | |
|---|---|---|---|---|
| EP | 0909477 | B1 | | 1/2002 |
| EP | 1659204 | A1 | | 5/2006 |
| EP | 1581682 | B1 | | 4/2008 |
| EP | 1580311 | B1 | | 7/2008 |
| EP | 1767686 | B1 | | 10/2008 |
| FR | 1354549 | | | 3/1964 |
| FR | 1354594 | A | | 3/1964 |
| JP | 60092798 | A | * | 5/1985 |
| JP | 2004-105267 | A | | 4/2004 |
| JP | 2007-29501 | A | | 2/2007 |
| JP | 2010012090 | A | | 1/2010 |
| KR | 1020040101001 | A | | 12/2004 |

* cited by examiner

WASHING MACHINE WITH A DIRECT DRIVE SYSTEM

CROSS-REFERENCE TO RELATED APPLICATIONS

Cross-reference is made to European Patent Application No. 08103960.4 entitled "Washing machine with a direct drive system," which was filed on May 14, 2008 and is expressly incorporated herein by reference.

TECHNICAL FIELD

The present disclosure relates generally to a washing machine and more particularly to a drive system for a washing machine.

BACKGROUND

The present disclosure relates to a washing machine with a so called direct drive system. More particularly, the present disclosure relates to a washing machine comprising a tub, a drum rotatably mounted inside the tub, a shaft centrally connected to the drum for transmitting the drive force of a motor, a coaxial support connected to the rear portion of the tub and having a seat for a first bearing supporting an end of the shaft opposite the drum, a stator of the motor supported by the coaxial support and having a plurality of magnetic cores, a rotor of the motor provided with permanent magnets and connected to the shaft, and a second bearing for supporting a portion of the shaft between its end and the drum.

This kind of washing machine is disclosed by FR-A-1354594. In this known machine the coaxial support is cup-shaped and is provided, on its concave side, with a cup-shaped auxiliary support to which the annular seat of the second bearing is fixed. The two cup-shaped supports define together a round chamber where the rotor and the stator are mounted. In this known construction, where the tub and the two above supports are made of metal, the annular seat of the second bearing is a metal hub with an external annular flange interposed between the rear portion of the metal tub and a central portion of the cup-shaped auxiliary support.

In view of the above features, the installation of the direct drive motor system to the washing machine is quite complex since at least two pieces have to be fastened to the tub, i.e. the cup-shaped "external" support and the cup-shaped "internal" auxiliary support. This complexity has prevented any appliance producer from adopting this technical solution.

Another similar solution is disclosed by U.S. Pat. No. 5,809,809 where the motor, with its stator and rotor, can be detached as a single component from the shaft, since the rotor present a central hub supported by the disk-shaped housing by means of two roller bearings. Even if this solution presents the advantage of keeping the components of the direct drive motor all together, on the other hand it is quite complex from a mechanical point of view and presents a higher number of components if compared to the traditional direct drive systems. Moreover in this solution all the mechanical loads of the drum are supported by an outside component (the disc-shaped motor) fixed on a rear face of the tub. This concentration of forces in the fastening area of the motor can create problems of reliability and safety.

Further features and advantages of the present invention will be clear from the detailed description of specific embodiments.

SUMMARY

According to one aspect of the disclosure, a washing machine with a direct drive system is disclosed. The washing machine includes a tub, a drum rotatably mounted inside the tub, a shaft connected to the drum at a first end for transmission of a driving force of a direct drive motor, a coaxial support connected to a rear portion of the tub and having a first seat for a first bearing supporting a second end of the shaft opposite the drum, a stator secured to the coaxial support and having a plurality of magnetic cores, a rotor including permanent magnets and connected to the shaft, and a second bearing for supporting the shaft between the second end and the first end. The tub is made of polymeric material in which a second seat for said second bearing is co-molded. In some embodiments, the coaxial support may be made of polymeric material, and the first seat for the first bearing may be co-molded with said coaxial support.

In some embodiments, the coaxial support and the tub may be made of a substantially identical polymeric material and are joined together by welding. Additionally, in some embodiments, the coaxial support and the tub may be joined together by friction welding. In some embodiments, the coaxial support and the tub may be fastened together by means of a fixing ring device.

In some embodiments, the stator may be centrally supported by an auxiliary bearing mounted on the rotor. In some embodiments, the stator may be prevented from rotating on the rotor by restraining means cooperating with corresponding portions of the coaxial support. In some embodiments, the coaxial support may be disc-shaped and the stator may be fixed to an inner surface of the coaxial support.

Additionally, in some embodiments, the rotor may be cup-shaped and may have an L-shaped flange including said permanent magnets. In some embodiments, the first seat of the first bearing may be fixed to or integral with a metal element extending from the seat to the stator. In some embodiments, the metal element may be disc-shaped and may be co-molded with the coaxial support.

In some embodiments, each of the coaxial support and the rotor may include a number of apertures that permit the flow of cooling air. In some embodiments, the coaxial support may include a first series of inner apertures and a second series of outer apertures. Additionally, in some embodiments, the rotor may include shaped ribs acting as blades for driving a cooling air flow.

According to another aspect, a method for installing a direct drive motor on a washing machine is disclosed. The method includes positioning a drum within a polymeric tub of a dishwashing machine, and inserting a shaft secured to the drum at a first end into a first bearing. The first bearing is positioned in a first seat co-molded in the tub. The method includes mounting a rotor including permanent magnets on the shaft after inserting the shaft into the first bearing, and placing a second bearing in a second seat of a coaxial support. The coaxial support has a stator secured thereto. The method also includes positioning the second bearing and the coaxial support on a second end of the shaft positioned opposite the first end, and securing the coaxial support to the tub.

In some embodiments, securing the coaxial support to the tub may include welding the coaxial support to the tub. In some embodiments, welding the coaxial support to the tub may include friction welding the coaxial support to the tub. Additionally, in some embodiments, securing the coaxial support to the tub may include fastening the tub to the coaxial support using a fixing ring device.

BRIEF DESCRIPTION OF THE DRAWINGS

The detailed description particularly refers to the following figures, in which.

DETAILED DESCRIPTION OF THE DRAWINGS

Figure 1:
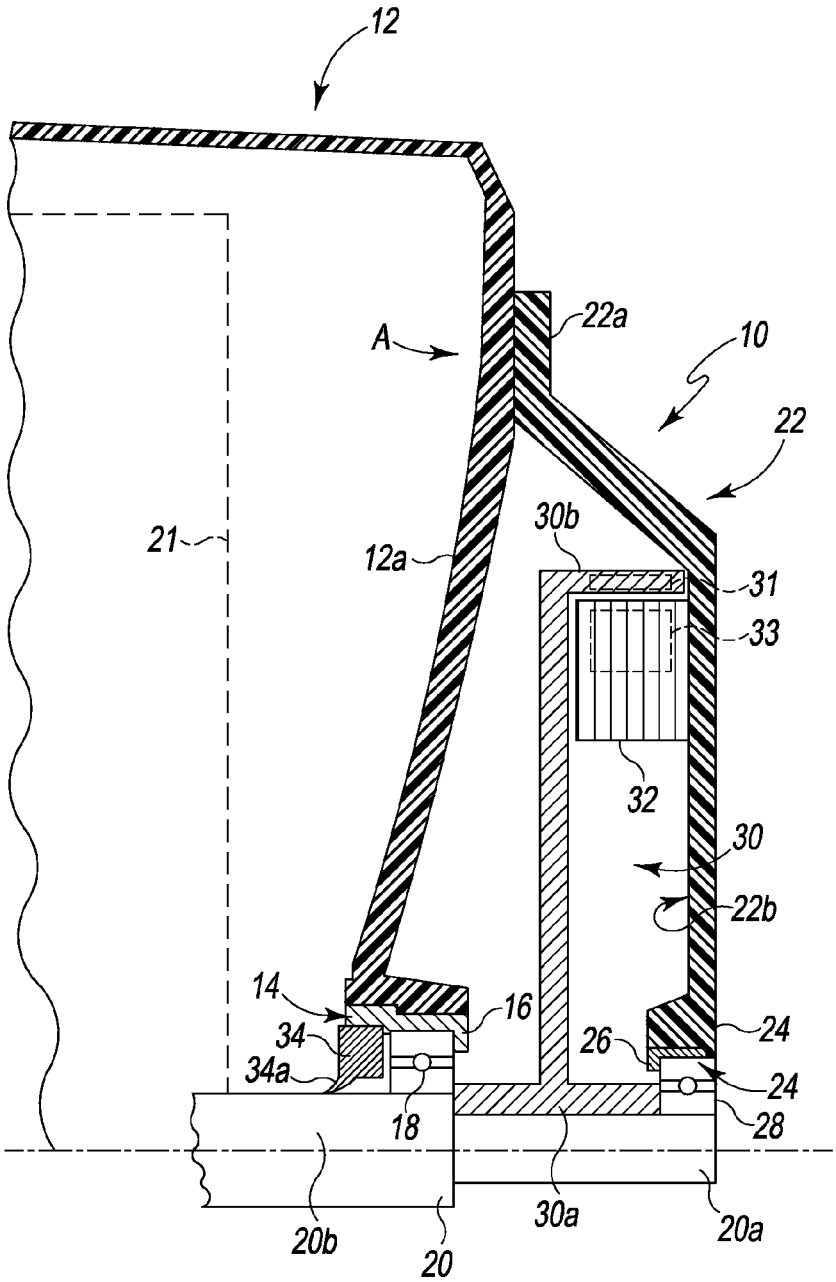
FIG. 1 is a fragmentary half-sectional view of a tub and of the direct drive system of a front loading washing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

With reference to FIG. 1, with 10 it is indicated the direct drive motor of a washing machine whose plastic tub is indicated with reference 12. The plastic tub 12 presents a rear circular wall 12*a* with a central hole 14 in which a metal hub 16 is installed. The metal hub 16, which is fixed to the tub 12 by a co-molding process, is the seat of a roller bearing 18 in which a shaft 20 of the drum 21 is rotatably mounted.

On a peripheral portion A of the rear wall 12*a* of the tub 12, the flange 22*a* of a disc-shaped plastic support part 22 is fixed by means of friction welding. In order to improve the quality of the friction welding, the polymeric material of the tub 12 and the polymeric material of the disc-shaped support part 22 are preferably identical. In a central hole 24 of the support part 22 a metal hub 26 is fixed by co-molding. The metal hub 26 is used as a seat of a roller bearing 28 which rotatably supports a free end 20*a* of the shaft 20.

Between the roller bearings 18 and 28, on the shaft 20 it is keyed a central hub 30*a* of a rotor 30 which presents an L-shaped flange 30*b* provided with a plurality of permanent magnets 31. The rotor 30 of the direct drive motor 10 cooperates with a stator 32 connected to an inner face 22*b* of the disc-shaped support part 22. The stator 32, as it is well known in the art of direct drive systems, is provided with a plurality of magnetic cores 33 driven by a control and power unit of the washing machine.

On the inner part of the hub 16, an annular gasket 34 is mounted for preventing the liquid in the tub 12 from flowing out. The gasket 34 has an inner lip 34*a* cooperating with a polished surface 20*b* of the shaft 20.

For mounting the motor 10 on the washing machine, the first step is to install the shaft 20 (carrying the drum) in the roller bearing 18. The second step is to install the rotor 30 on the shaft 20 so that the rotor is rotationally fixed to the shaft. Then the last step is to center the support part 22 with the stator 32 on the end 20*a* of the shaft 20, by also frictionally welding the support part 22 to the tub 12.

Figure 2:
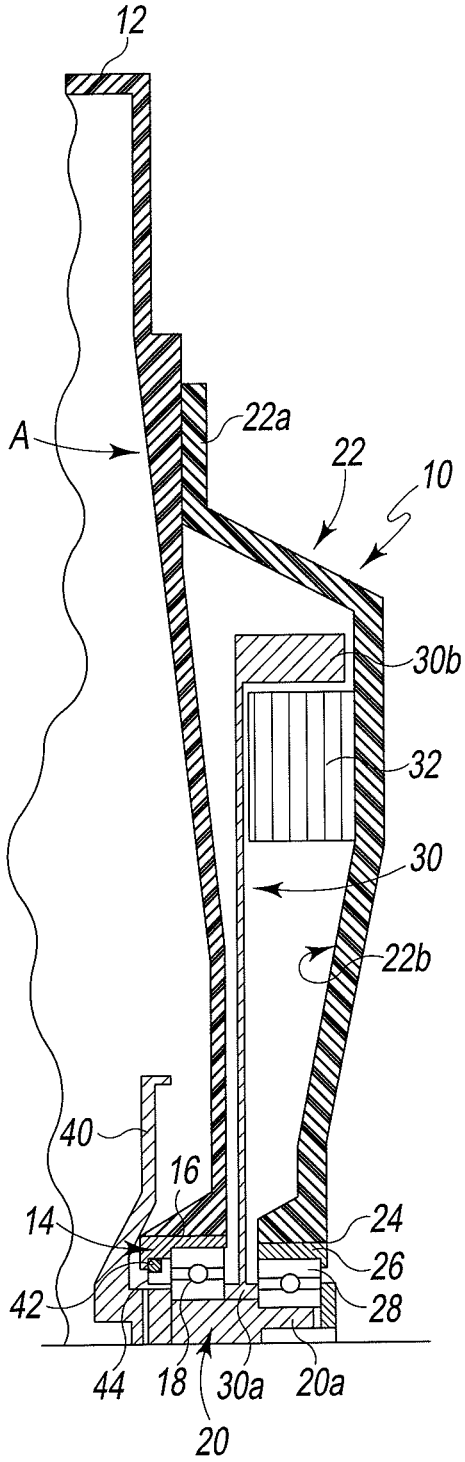
FIG. 2 is a view similar to FIG. 1 and relates to a top-loading washing machine.

In FIG. 2 the solution for a top-loader is almost identical to the solution for a front loader, and the main difference is the reduced space taken by the direct drive motor and the related bearings assembly. In FIG. 2 the same components are indicated with the same reference numerals of FIG. 1. In the version of the top loader, the shaft 20 ends inside the tub 12 with an annular flange 40 fixed to a circular side (not shown) of the drum. In this version a circular gasket 42, in the form of an O-ring, cooperates with a L-shaped ring 44 fixed on the shaft 20.

Figure 3:
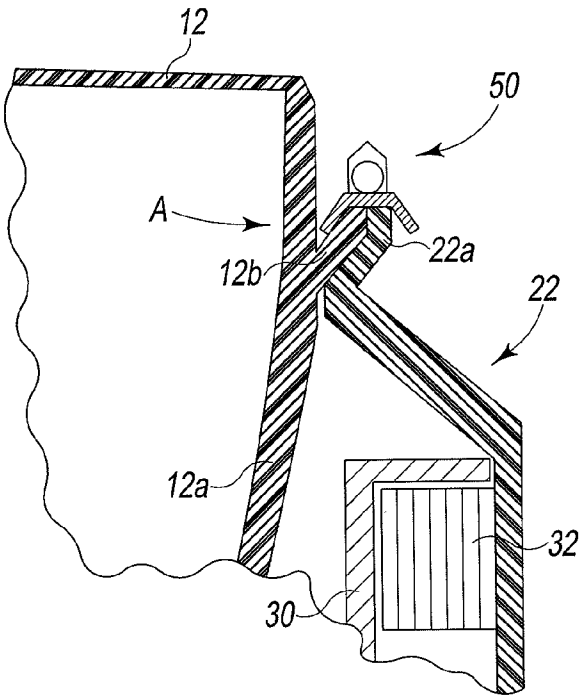
FIG. 3 is a fragmentary sectional view of a detail of FIG. 1 according to a second embodiment.

In FIG. 3 another embodiment is shown in which the disc-shaped plastic support 22 is fastened to the tub 12 by means of a fastening ring 50 formed by a metal V-band. Such ring 50 is clamped in a known manner on a peripheral protruding portion 12*b* of the tub 12 and on the flange 22*a* of the support part 22.

Figure 4:
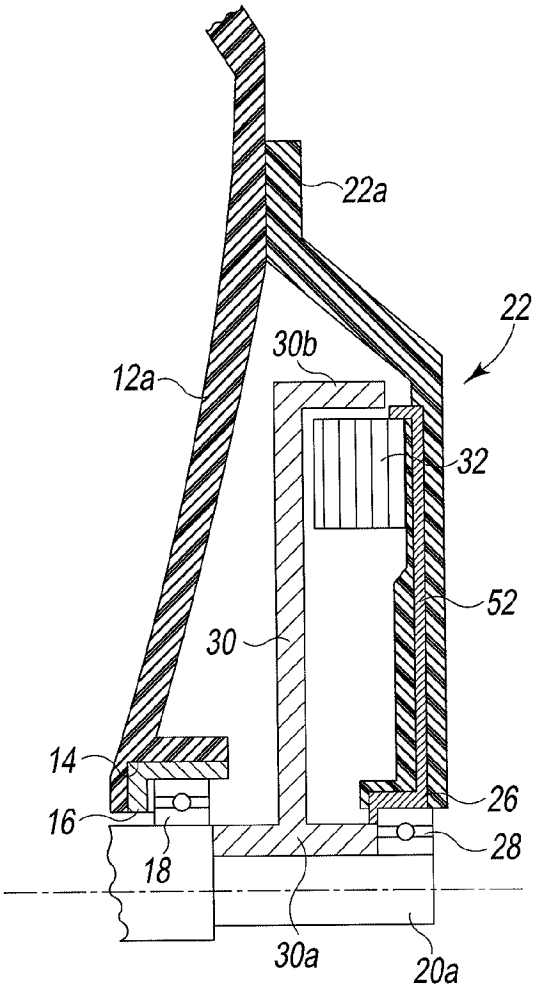
FIG. 4 is a view similar to FIG. 1 and it shows a third embodiment.

With reference to FIG. 4, a third embodiment is shown in which a metal disc-shaped sheet or plate 52 is fixed to or integral with the metal hub 26 used as a seat for the roller bearing 28. The metal sheet 52 can be co-molded with the plastic support part 22 (solution shown in the drawings) or it can be fixed to an inner or outer face thereof. The metal sheet 52 extends the metal hub 26 to the outside diameter of the stator 32, therefore increasing the stiffness of the overall direct drive motor assembly and allowing the stator 32 to be mounted on a metal component for reducing the mounting tolerances of the stator 32.

Figure 5:
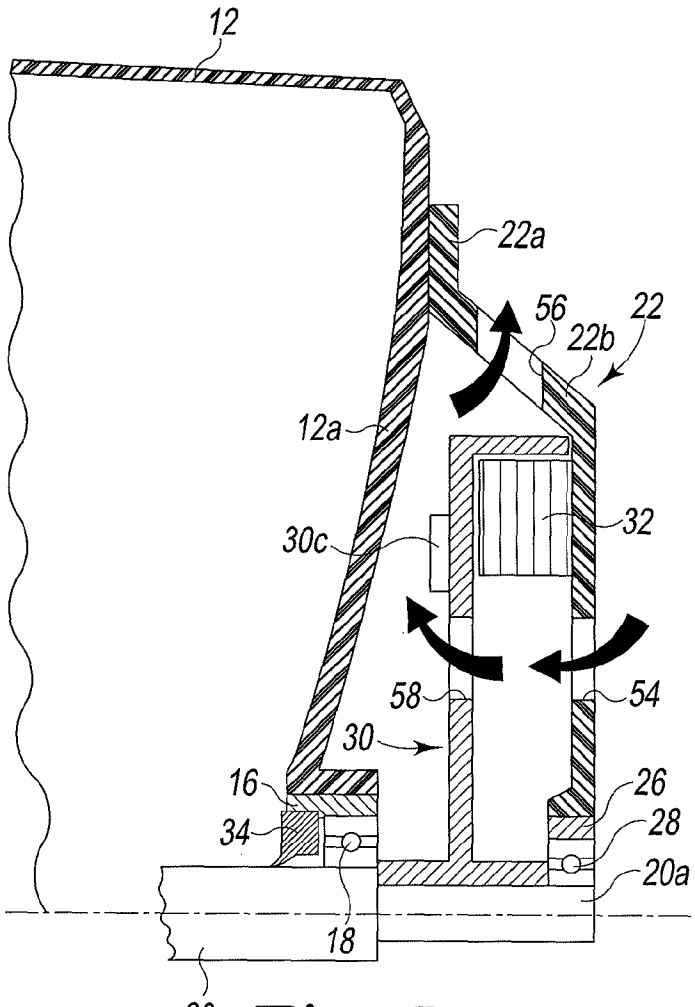
FIG. 5 is a view similar to FIG. 1 and it shows a fourth embodiment.

In the fourth embodiment shown in FIG. 5 the support part 22 is provided with a first series of apertures or holes 54 and with a second series of apertures or holes 56. The holes 54 are placed in a central flat portion of the support part 22 and the holes 56 are placed in an outer inclined portion 22*b* of the support part 22. The rotor 30 is further provided with a plurality of apertures or holes 58 in order to allow a free airflow inside the inner space defined by the support part 22 and by the rear wall 12*a* of the tub 12. In order to create a stronger continuous flow of cooling air (flow schematically shown in FIG. 5 by arrows), the rotor 30 is provided with a plurality of shaped ribs 30*c* adjacent the L-shaped flange 30*b*. The ribs 30*c* act as blades of a cooling fan, therefore reducing the working temperature of the motor.

Figure 6:
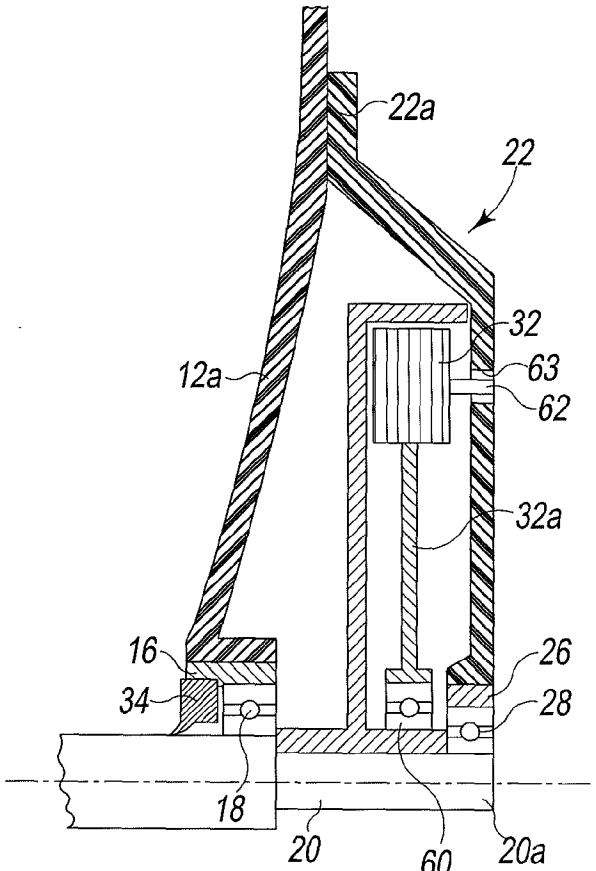
FIG. 6 is a view similar to FIG. 1 and it shows a fifth embodiment.

In the fifth embodiment shown in FIG. 6 the stator 32 is not fastened to the support part 22 as in the previous embodiments, rather it is centered to the rotor 30 by means of an additional bearing 60 and it is restrained by a pin 62 to the support part 22. The stator 32 is therefore provided with a disc-shaped support 32*a* mounted on the outer ring of the additional bearing 60, the inner ring of such bearing 60 being mounted on the central hub 30*a* of the rotor 30. In this embodiment the stator 32 is prevented from turning by means of the pin 62 (or by means of a plurality of pins) inserted in a corresponding seat 63 of the support part 22, with a flexible mount against the support part 22.

Even if in the above embodiments the rotor 30 is shown as a cup-shaped rotor, it is clear that the rotor may have other configurations, for instance purely disc-shaped configurations or configurations with a double L-shaped flange (i.e. T-shaped flange) carrying magnets on the two portions of the flange, without departing from the scope of the present invention. Similarly, the stator 32 too can have different configurations, and the poles thereof can also be U-shaped when a purely disc-shaped configuration of the rotor 30 is adopted.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A washing machine with a direct drive system comprising:

a tub, a drum rotatably mounted inside the tub, a shaft connected to the drum at a first end for transmission of a driving force of a direct drive motor, a coaxial support connected to a rear portion of the tub and having a first seat, a first bearing positioned in the first seat, the first bearing supporting a second end of the shaft opposite the drum, a stator secured to the coaxial support and having a plurality of magnetic cores, a rotor including permanent magnets and connected to the shaft, and a second bearing for supporting the shaft between the second end and the first end, wherein the tub is made of polymeric material in which a second seat for said second bearing is co-molded, wherein the rotor includes (i) a base connected to the shaft between the first bearing and the second bearing, and (ii) an arm positioned between the stator and tub that extends outwardly from the base, wherein the first bearing and the second bearing support an external surface of the shaft and the base extends along the external surface of the shaft such that a first end of the base is directly adjacent to the first bearing and a second end of the base is directly adjacent to the second bearing.

2. The washing machine of claim 1, wherein the coaxial support is made of polymeric material, the first seat for the first bearing being co-molded with said coaxial support.

3. The washing machine of claim 2, wherein the coaxial support and the tub are made of a substantially identical polymeric material and are joined together by welding.

4. The washing machine of claim 3, wherein the coaxial support and the tub are joined together by friction welding.

5. The washing machine of claim 1, wherein the coaxial support and the tub are fastened together by means of a fixing ring device.

6. The washing machine of claim 1, wherein the stator is centrally supported by an auxiliary bearing mounted on the rotor.

7. The washing machine of claim 6, wherein the stator is prevented from rotating on the rotor by restraining means cooperating with corresponding portions of the coaxial support.

8. The washing machine of claim 1, wherein the coaxial support is disc-shaped and the stator is fixed to an inner surface of the coaxial support.

9. The washing machine of claim 1, wherein the rotor is cup-shaped and has an L-shaped flange including said permanent magnets.

10. The washing machine of claim 9, wherein the first seat of the first bearing is fixed to or integral with a metal element extending from the first seat to the stator.

11. The washing machine of claim 10, wherein the metal element is disc-shaped and is co-molded with the coaxial support.

12. The washing machine of claim 1, wherein each of the coaxial support and the rotor includes a number of apertures that permit the flow of cooling air.

13. The washing machine according to claim 12, wherein the coaxial support includes a first series of inner apertures and a second series of outer apertures.

14. The washing machine of claim 13, wherein the rotor includes shaped ribs acting as blades for driving a cooling air flow.

* * * * *